US012111051B2

(12) United States Patent
Breccia et al.

(10) Patent No.: US 12,111,051 B2
(45) Date of Patent: Oct. 8, 2024

(54) GAS BURNER

(71) Applicant: E.G.O. ELEKTRO-GERÄTEBAU GMBH, Oberderdingen (DE)

(72) Inventors: Luca Breccia, Camerano (IT); Davide Rinaldi, Camerano (IT); Donato Migliori, Camerano (IT)

(73) Assignee: E.G.O. ELEKTRO-GERÄTEBAU GMBH, Oberderdingen (DE)

( * ) Notice: Subject to any disclaimer, the term of this patent is extended or adjusted under 35 U.S.C. 154(b) by 399 days.

(21) Appl. No.: 17/620,068

(22) PCT Filed: Jul. 2, 2020

(86) PCT No.: PCT/IB2020/056245
§ 371 (c)(1),
(2) Date: Dec. 16, 2021

(87) PCT Pub. No.: WO2021/001775
PCT Pub. Date: Jan. 7, 2021

(65) Prior Publication Data

US 2022/0316701 A1 Oct. 6, 2022

(30) Foreign Application Priority Data

Jul. 4, 2019 (IT) ..... 1020190000010935

(51) Int. Cl.
*F23D 14/06* (2006.01)

(52) U.S. Cl.
CPC .... *F23D 14/06* (2013.01); *F23D 2900/14062* (2013.01)

(58) Field of Classification Search
CPC ..... F23D 14/06; F23D 2900/14062; F23D 2900/14063
(Continued)

(56) References Cited

U.S. PATENT DOCUMENTS 5,704,778 A 1/1998 Hsieh
6,263,868 B1 * 7/2001 Koch ..... F23D 14/06 431/278
(Continued)

FOREIGN PATENT DOCUMENTS

EP 1028286 A2 12/1999
EP 1838997 A1 10/2007
(Continued)

*Primary Examiner* — Vivek K Shirsat
(74) *Attorney, Agent, or Firm* — Carmel Patent Agency; Robert Ballarini

(57) ABSTRACT

A multi-crown gas burner with an injector holder module is attachable to a cooking hob and includes a flame-spreader module, positioned above the injector holder module, which includes a circular internal portion separated from an external annular portion by a substantially annular cavity. The injector holder module includes:

Figure 1:
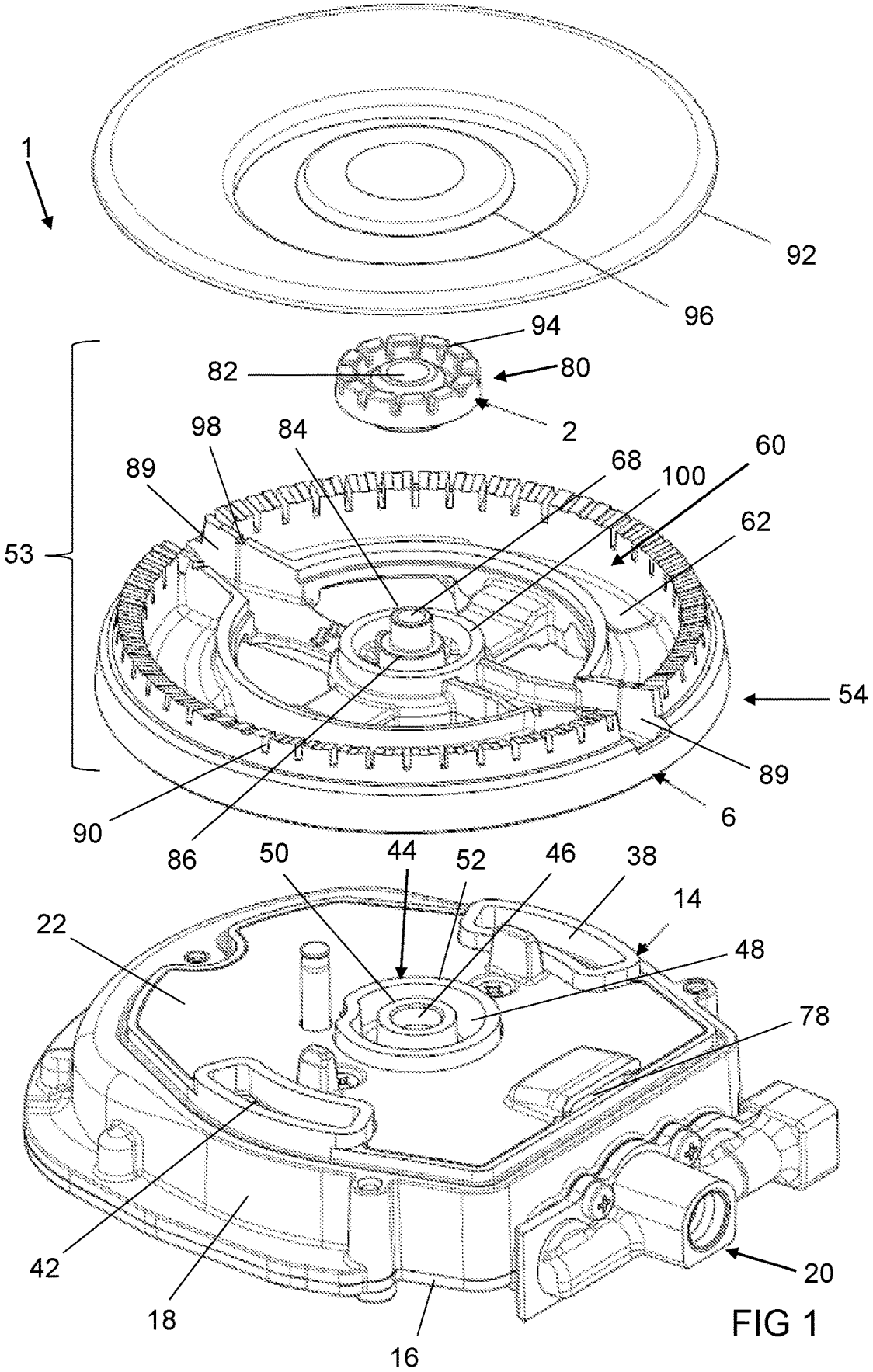

at least one first venturi duct substantially horizontal to which at least one first injector faces, the at least one first venturi duct in fluid communication with a corresponding first chamber in fluid communication with a first set of doors provided in said external annular portion, so as to generate at least one first crown of main flames, a second substantially horizontal venturi duct to which a second injector, the second venturi duct is in fluid communication with a zone communicating fluidly with at least one passage provided in said circular internal portion for generating at least one simmering flame.

15 Claims, 4 Drawing Sheets

(58) Field of Classification Search
USPC ..... 126/39 E, 39 R; 431/354
See application file for complete search history.

(56) References Cited

U.S. PATENT DOCUMENTS

| | | | | |
|---|---|---|---|---|
| 2012/0070791 | A1* | 3/2012 | Armanni | F23D 14/065 431/354 |
| 2018/0106476 | A1 | 4/2018 | Breccia et al. | |

FOREIGN PATENT DOCUMENTS

| | | | |
|---|---|---|---|
| WO | 2006077086 | A1 | 7/2006 |
| WO | 2010096403 | A1 | 8/2010 |

* cited by examiner

GAS BURNER

The present invention relates to a multi-crown gas burner, and in particular to a multi-crown gas burner with crowns of flame controlled independently by different outputs of a single tap (dual burner).

Burners of this type are generally used in hobs in general, and in built-in hobs in particular.

A dual burner is controlled by a two-outlet tap, which through two distinct injectors feeds the various crowns of flame in a differentiated and independent manner (dual tap). More particularly, one injector feeds the crown or crowns of the external (annular) body of the burner, while the other injector supplies the crown of the central (circular) body of the burner.

Also known from EP 1028286 and EP 1838997 are burners with simmering (or slow boiling) flame, arranged in the annular body of the burner and fed, possibly together with a crown of main flames, by one of the two injectors controlled by the dual tap. Given the position of the simmering flame in the annular portion of the multi-crown burner, this simmering flame develops along a circumference of relatively large diameter and has a flow rate that cannot be reduced beyond certain limits, without compromising its stability and its ability to propagate.

A multi-crown burner with a simmering flame in the inner central portion of the burner is also known from WO 2010/096403. It allows to have a low flame flow without compromising its stability and its propagation capacity, but at the same time it provides that the main crowns of flame are present only on the external annular body and are fed with a combustible mixture generated with vertical venturi ducts and this on the one hand involves a high vertical size of the burner, with important constraints for its mounting on built-in cooking hobs, and on the other hand it limits the maximum power that can be supplied by the burner.

A problem that often occurs in simmering gas burners is that in order to have a low simmering flow rate, it uses an injector with an extremely small hole (0.2-0.4 mm in diameter), and this is subject to frequent fillings due to the possible overflow of liquids during the use of the burner and in any case to the deposit of dirt linked to the environment in which it operates, characterized by the presence of fatty vapors.

US2018/106476, US2012/070791 and U.S. Pat. No. 5,704,778 describe a multi-crown gas burner with a cup body that can be attached to a cooking hob, with a flame-spreader overlying said cup body and having an circular internal portion and an external annular portion; furthermore, a first venturi duct is provided, which is in fluidic communication with said external annular portion of the flame-spreader, and a second venturi duct, which is in fluidic communication with the circular internal portion of said flame-spreader.

The object of the invention is to propose a gas burner capable of overcoming, at least in part, the aforementioned drawbacks found in traditional solutions.

Another object of the invention is to propose a dual-type multi-crown gas burner and to be mounted in particular on built-in hobs.

Another object of the invention is to propose a burner with a high turndown, i.e. with a wide adjustment range from the minimum flow to the maximum flow.

Another object of the invention is to propose a gas burner with very low simmering flow rate.

Another object of the invention is to propose a gas burner which, despite the very low simmering flow rate, ensures satisfactory stability and flame spreading capacity.

Another object of the invention is to propose a gas burner, in which the risks of obstruction of the injector, which feeds the gas flow for the generation of the simmering flame, are practically eliminated.

Another object of the invention is to provide a gas burner which can be obtained simply, quickly and with low costs.

Another object of the invention is to propose a gas burner which is formed with a limited number of pieces and therefore which is easy to assemble and with low costs.

Another object of the invention is to propose a gas burner that has safe operation.

Another object of the invention is to propose a gas burner with a rather limited vertical dimension and therefore capable of being installed even on hobs of minimum thickness.

Another object of the invention is to propose a gas burner which has an alternative and/or improvemed constructive and functional characterization with respect to the traditional ones.

All these purposes, considered both individually and in any combination thereof, and others that will result from the following description are achieved with a gas burner as defined in claim 1.

Figure 2:
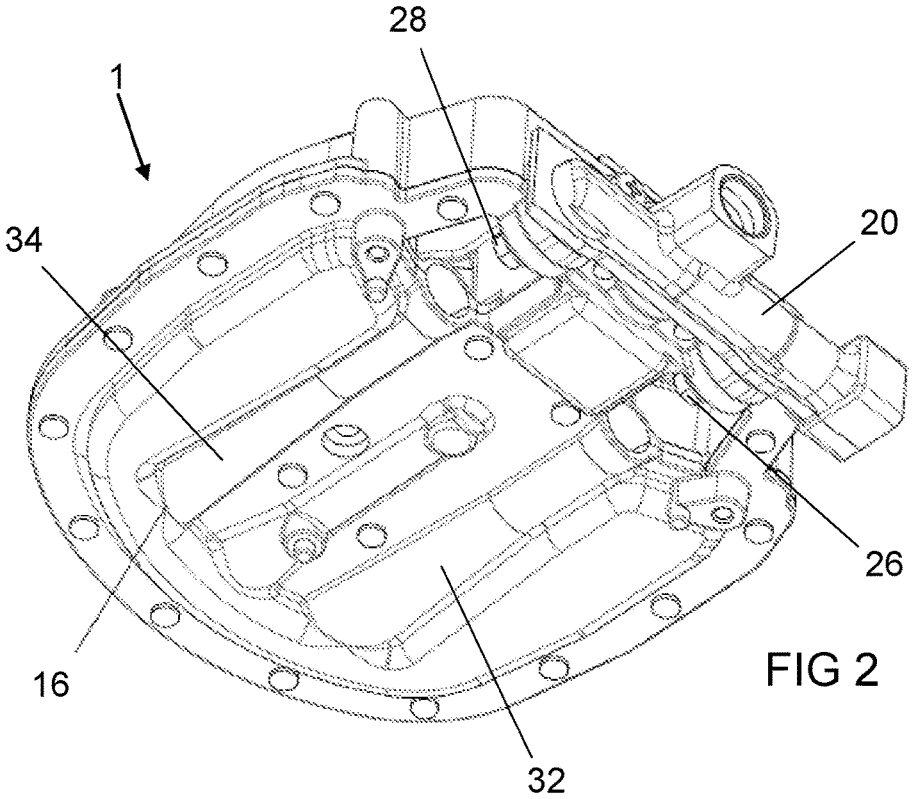
Figure 3:
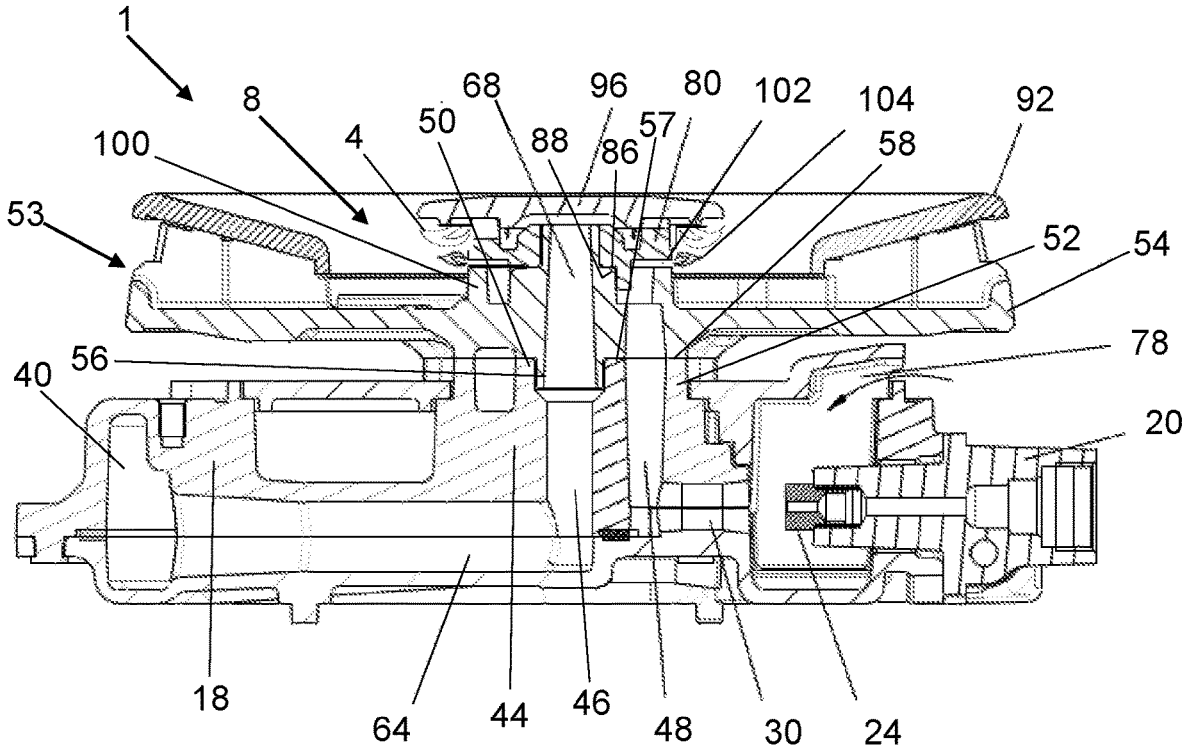
Figure 4:
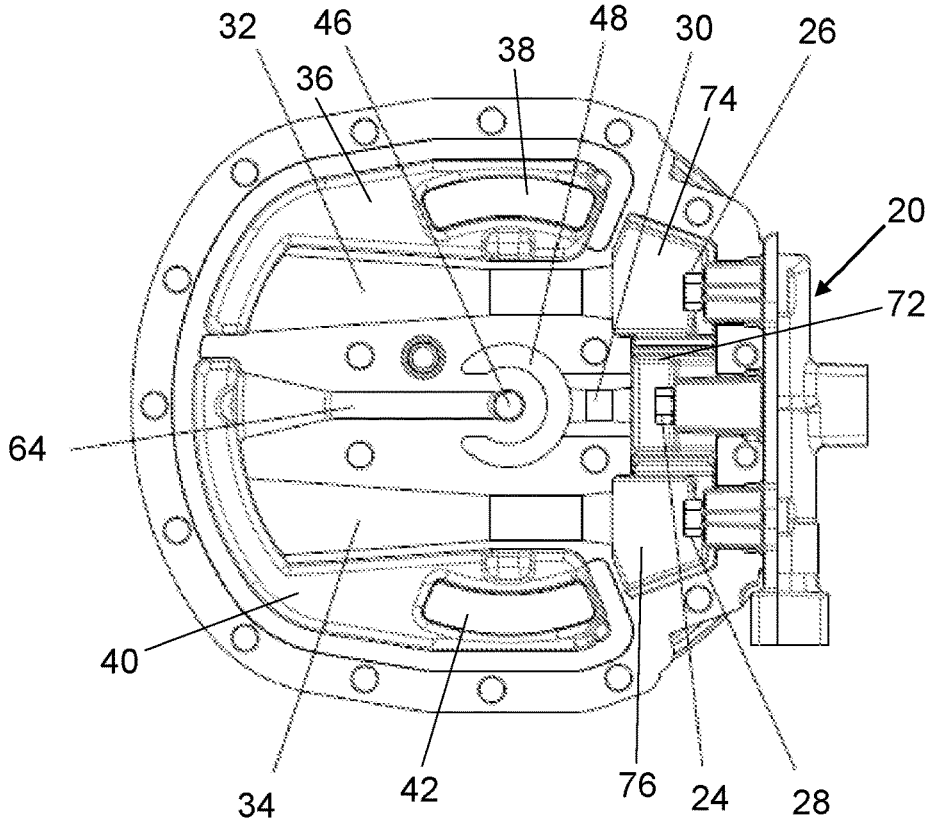
Figure 5:
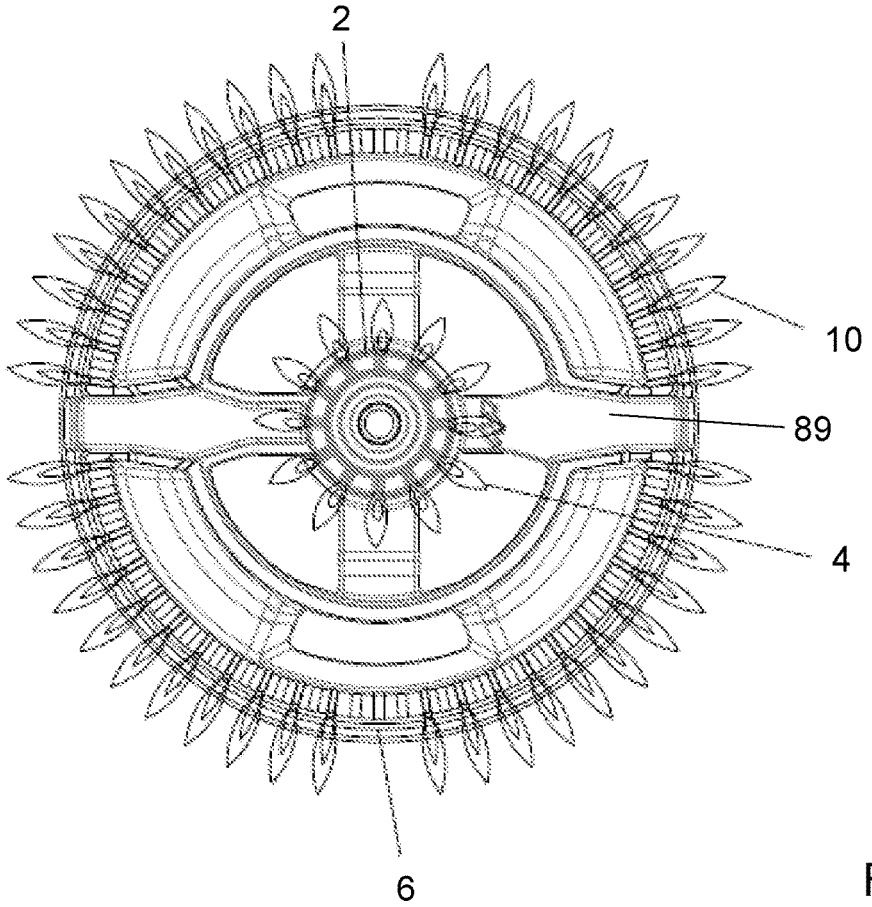
Figure 6:
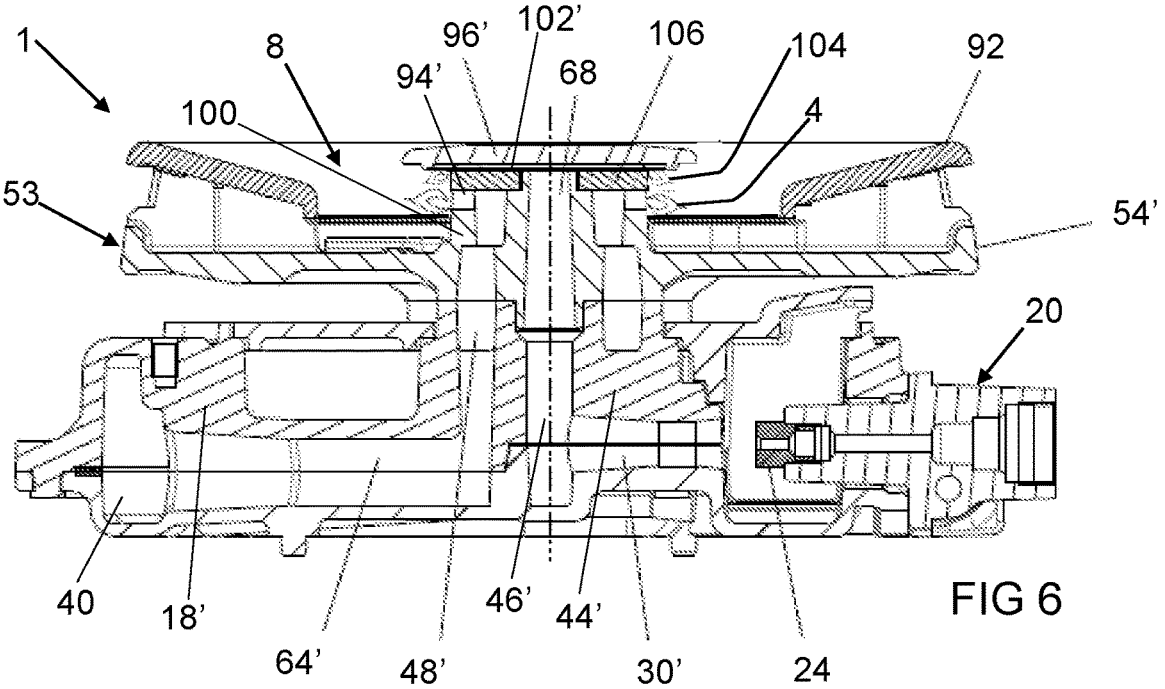
Figure 7:
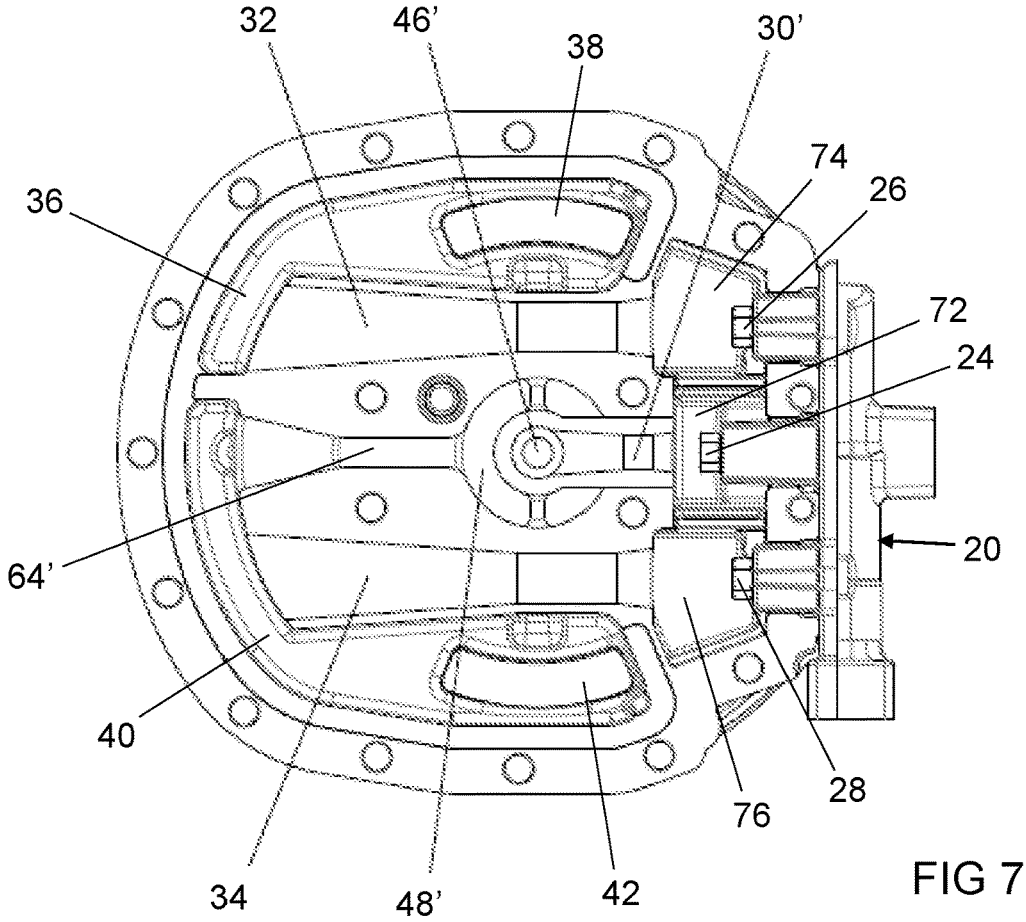

The present invention is further clarified below in some of its preferred forms of practical embodiment shown for purely exemplary and non-limiting purposes with reference to the attached drawings, in which:

FIG. 1 shows an exploded perspective view of a multi-crown gas burner according to the invention in a first embodiment, FIG. 2 shows in perspective view from below its cup body, FIG. 3 shows it in a diametrical vertical section, FIG. 4 shows it in plane view from below, FIG. 5 schematically shows in plane view the flame-spreader without cover, FIG. 6 shows in vertical section the burner according to the invention in a different embodiment, and FIG. 7 shows it in plan view from below, As can be seen from the figures, the burner 1 according to the invention is of a type suitable for being mounted on cooking hobs.

Preferably but not exclusively, the burner 1 is of the type suitable for being mounted on built-in hobs, which require burners of limited vertical dimensions given the limited space available in the hob itself. Suitably, the burner 1 can be mounted both on built-in hobs and on hobs of kitchen furniture, for example on hobs positioned above an oven.

The burner 1 according to the invention is of the multiring or multi-crown type, i.e. with a flame-spreader module 53 comprising an circular internal portion 2, from which an internal crown of main flames 4 originates, and an external annular portion 6, which is separated from a cavity 8, with a substantially annular development (which can be continuous or discontinuous), from the circular internal portion 2 and from which one or two first (external) crowns of main flames 10 originate. Conveniently, in the case of a single first (external) crown of flames 10, this is facing outwards, while in the case of two first (external) crowns of flames, one is facing outwards and the other is facing the annular cavity 8 separating the two portions 2 and 6 of the burner.

The burner 1 according to the invention comprises an injector holder module 14. Conveniently, said injector holder module 14 is defined by a cup body which preferably comprises a lower shell 16, an overlying cup 18, an injector holder 20 and an upper closing cover 22. The injector holder module 14 is intended to be positioned below the hob in correspondence with an opening formed therein.

Preferably, the lower shell 16 is stably fixed to the cup 18 by riveting; preferably, while the injector holder 20 is constrained laterally to the assembly formed by the lower shell 16 and the cup 18, already fastened together, by means of screws, which allow their mutual separation. Advantageously, the cover 22 is also secured to the cup 18 by means of screws.

The burner 1 also comprises a flame-spreader module, indicated as a whole with the reference 53, which is positioned—preferably resting—above the injector holder module 14 and comprises said circular internal portion 2 and said external annular portion 6. In particular, as said, the external annular portion 6 is substantially concentric to the circular internal portion 2 and is separated from the latter by a substantially annular cavity 8.

Inside the injector holder module 14, and in particular, within its overall dimensions in plane, are provided:

- at least one first substantially horizontal venturi duct 32 and/or 34, to which at least one first injector 26 and/or 28 faces, which is intended to be fed by a first outlet of a dual tap; said at least one first venturi duct 32 and/or 34 is in fluid communication with a corresponding first chamber 36 and/or 40 which is fluidly communicating with a first cavity 60 obtained in the external annular portion 6 of the flame-spreader module 53, and in particular it is communicating fluidly with a first series of doors formed in said cavity 60, for the generation of at least one first crown of main flames 10,
- a second substantially horizontal venturi duct 30 or 30', to which a second injector 24 faces, which is intended to be fed by a second outlet of said dual tap; said second venturi duct 30 or 30' is in fluid communication with an area—which can be defined by a second chamber 48 or by a duct 46'—which is fluidly communicating with a second cavity obtained in said circular internal portion 2 of the flame-spreader module 53, and in particular it is in communication with a passage for the generation of a simmering flame 104.

Conveniently, the injector holder module 14 and the flame-spreader module 53 are configured individually and in their union/combination, so as to define inside their size:

- a first fluid circuit, associated with said at least one first injector 26 and/or 28, for supplying gas and primary air to the first crown of main flames 10 provided in correspondence of the external annular portion 6 of flame-spreader module 53,
- a second fluidic circuit, associated with said second injector 24, to feed the simmering flame 104 gas and primary air provided at the circular internal portion 2 of the flame-spreader module 53,
- a third fluidic circuit, which is in communication with said first fluidic circuit, for feeding with gas and primary air a second crown of main flames 4 provided at the circular internal portion 2 of the flame-spreader module 53.

Advantageously, the first chamber 36 and/or 40, in which said at least one first venturi duct 32 and/or 34 opens, communicates fluidly with at least one annular distribution chamber obtained in the external annular portion 6 of said flame-spreader module 53 and with a circular distribution chamber obtained in the circular internal portion 2 of said flame-spreader module 53.

Advantageously, the second injector 24, which is associated with the fluidic circuit for feeding the simmering flame 104, comprises a calibrated hole for the exit of the gas of very small diameter, preferably in the order of 0.2-0.3 mm.

Advantageously, three injectors 24, 26 and 28 are applicable to the injector holders 20, one of which is central 24, preferably arranged substantially on the diametrical plane of the burner, and two lateral ones 26, 28 arranged on both sides of the central one. Suitably, all the injectors have parallel and horizontal or substantially parallel and substantially horizontal axes. Suitably, said at least one first injector can be defined by said two lateral injectors 26 and 28, while said second injector can be defined by said central injector 24.

In a position aligned with the axis of the injectors 24, 26 and 28, in the injector holder module 14 are obtained three venturi ducts 30, 32 and 34, and in particular a central venturi duct 30 and two lateral venturi ducts 32, 34. Suitably, the ducts 30, 32, 34 define a linear venturi, in which the mixing of the gas with the air by the Venturi effect occurs mainly through the corresponding ducts. Conveniently, the ducts 30, 32 and 34 are horizontal and/or substantially horizontal, i.e. inclined up to about 30-40° with respect to the horizontal.

Conveniently, said at least one first venturi duct can be defined by said two lateral venturi ducts 32 and 34, while said second venturi duct can be defined by said central venturi duct 30.

In the embodiments described below and represented in the figures, two are provided first injectors (i.e. the lateral injectors 26, 28) facing two corresponding first venturi ducts (i.e. the lateral venturi ducts 32, 34), however a single first injector could also be provided which is aligned and facing only one first venturi duct.

Advantageously, a first lateral venturi duct 32 leads into a first chamber 36, which is provided with an upper opening 38 obtained in the cup 18, while the other lateral venturi duct 34 leads into a corresponding further first chamber 40, provided with an upper opening 42, also obtained in the cup 18, preferably in a substantially diametrical position with respect to the opening 38.

Advantageously, also in the cup 18 there is also a central portion 44 shaped as a cylindrical or slightly frusto-conical turret, presenting an axial duct 46 and a second chamber 48, preferably substantially annular, which develops coaxially with said duct 46. Preferably, this second chamber 48 is internally delimited by a first substantially cylindrical wall 50, which advantageously is also the external wall of the axial duct 46, and externally by an other substantially cylindrical wall 52 with a larger diameter.

Advantageously, in the central portion 44 of the injector holder module 14 and in the overlying central portion of the flame-spreader 54 or 54' two fluidic passages are provided, with a substantially vertical development and fluidically separated/distinct from each other, which receive two separate flows of primary gas-air mixture and formed respectively in said at least one first venturi duct 32 and/or 34 and in said second venturi duct 30 or 30'. In particular, a first fluidic passage is defined by the axial duct 46 or 46' obtained in the central portion 44 of the injector holder module 14, and by the overlying vertical duct 68 obtained in the flame-spreader module 53, while a distinct/second fluidic passage is defined by the second chamber 48 or 48' obtained in said injector holder module 14 and by the relative extension obtained in the flame-spreader module 53.

Advantageously, both the edge of the two openings 38, 42 of the first chambers 36, 40 and the edge of the two cylindrical walls 50, 52 of the central portion 44 protrude slightly beyond the cover 22 of the injector holder module 14 and constitute, as will be better seen below, support for the flame-spreader module 53.

Suitably, the flame-spreader module 53 can comprise an external annular flame-spreader 54 and an internal circular flame-spreader 80, which preferably can be made in one piece or in two separate pieces.

Conveniently, the external annular portion 6 is defined in the external annular flame-spreader 54 and furthermore comprises an internal annular portion 100. Conveniently, the external annular portion 6 and the internal annular portion 100 of the external annular flame-spreader 54 connected to each other by two or more radial strokes.

In particular, the internal annular portion 100 of the external annular flame-spreader 54 can be directly provided with slots 94' for the exit of the second flame crown 4 (see FIGS. 6 and 7), or it can define a support zone for a further dedicated element, which thus defines the internal circular flame-spreader 80, which is provided with doors 94 for the escape of the second flame crown 4.

Advantageously, the annular flame-spreader 54 engages with its central tubular internally hollow appendage 56 inside the cylindrical wall 50 of the turret portion 44, leans with its annular step 57, which surrounds said hollow central appendage 56, to the upper edge of said cylindrical wall 50, and also leans with its annular surface 58, concentric with the annular step 57, at the upper edge of the external cylindrical wall 52 of the turret portion 44.

Furthermore, in the external annular portion 6 of the annular flame-spreader 54 is obtained a first cavity 60, with a substantially annular development (continuous or discontinuous), which defines the external annular distribution chamber; the first cavity 60 which presents on the bottom a pair of openings 62, corresponding to the openings 38, 42 of the cup 18 and each delimited by a downward protruding edge, intended to rest on the edge of the corresponding opening 38, 42 when the annular flame-spreader 54 is placed on the injector holder module 14.

At least one of said first chambers, and in particular the first chamber 40, in which said at least one first venturi duct (and in particular the lateral venturi duct 34) opens, also communicates, through an internal duct 64, with the vertical duct 46, running axially inside the central portion 44 of the cup 18, and with an overlying vertical duct 68, obtained in the internal portion of the flame-spreader 54. Conveniently, said internal duct 64 is of horizontal development and/o slightly inclined and is defined within the overall dimensions of the injector holder module 14, and preferably of the cup 18. Preferably, the internal duct develops radially from the periphery towards the center of the injector-holder module 14.

The second venturi duct 30, preferably the central one, has the downstream end which leads into the annular chamber 48 of the central portion 44.

Advantageously, inside the injector-holder module 14 at least two wells are obtained for housing respectively at least one first injector 26 and/or 28 and said second injector 24, which are suitably applied to the side wall of the relative well opposite to that from which the respective venturi ducts 30 and/or 32, and 34. Preferably, three wells 72, 74 and 76 are provided inside the injector holder module 14 for housing the three corresponding injectors 24, 26 and 28, which are applied to the side wall of the relative pit opposite to that, from which the three venturi ducts 30, 32 and 34 branch off.

Advantageously, in the embodiment illustrated in the FIGS. 1-5, the well 72, which houses the central injector 24 is closed at the bottom and communicates with the external area surrounding the burner and positioned above the hob through an opening 78, made in the cover 22 of the injector holder module 14. The other side wells 74, 76 are closed at the top and open at the bottom, in order to be able to suck in the primary air from under the hob.

Conveniently, as mentioned, the burner according to the invention can also comprise an internal circular flame-spreader 80; preferably, it has a central opening 82 intended to receive by axial insertion, a corresponding hollow cylindrical appendix 84 of the annular flame-spreader 54. This hollow appendix 84 delimits the vertical duct 68 and presents at the bottom an annular step 86, to which it rests anannular counter-step 88 obtained in said internal flame-spreader 80.

Preferably, the first cavity 60, with a substantially annular development, of the external flame-spreader 54 is delimited by two cylindrical or slightly frusto-conical walls, one external and one internal, which are not continuous, but are interrupted in diametrical positions from walls having a substantially radial shape, which delimit two radial channels 89 dividing the cavity 60 into two substantially semicircular cavities.

Conveniently, the outer annular wall of the first cavity 60 of the outer annular flame-spreader 54 presents on the upper edge a plurality of slots 90, which with an annular cover 92 form a series of doors for the generation of the outer crown of main flames 10.

Conveniently, in an embodiment not shown, the internal annular wall of the first cavity 60 can also present slots for the generation of a crown of flames which is internally concentric with the previous one and not shown in the drawings.

Conveniently, the outer circular edge of the central flame-spreader 80 presents a plurality of slots 94, which with a circular cover 96 form a series of doors for the generation of the internal crown of main flames 4.

Advantageously, slots 98 formed in the delimitation walls the two radial channels 89 of the annular flame-spreader 54 favor the inter-ignition between the crowns of flame.

When the burner is mounted on the hob, the injector holder module 14 is traditionally fixed to the upper plate of the latter, the two gas inlets which lead to the injector holder 20 and which respectively feed the central injector 24 and the two lateral injectors 26 and 28, are connected to the two outlets of a dual tap (not shown), the annular flame-spreader 54 is placed on the injector holder module 14, so that the two openings 62 obtained on it match with the two openings 38 and 42 of the two first chambers 36 and 40 provided in the injector holder module 14, the central hollow appendage 56 of the flame spreader 54 is inserted inside the cylindrical part 50 of the turret portion 44, the annular cover 92 is placed on the flame spreader 54, the central flame spreader 80 is placed on the annular flame-spreader 54 so that the central appendix 84 of the latter is inserted within the central opening 82 of the former, and the circular cover 96 is placed on the central flame-spreader 80.

In this condition the various parts are configured so that between the lower outer edge of the central flame spreader 80 and the underlying edge of an internal annular portion 100 of the external annular flame spreader 54 a passage is defined, preferably defined by a small circumferential continuous slot 102, communicating with the second chamber 48 of the central portion 44 of the injector holder group 14 and with its upper extension obtained in the internal annular portion 100 of the flame-spreader 54.

The operation of the burner 1 according to the invention in this first embodiment is the following: the gas that comes from an outlet of the dual tap feeds the second injector 24, which is intended to generate a simmering flame 104. The escape of the gas from the second injector 24 causes the primary air to come from above the hob through the opening 78, obtained in the cover 22 of the injector holder module 14, and the conveyance of both into the second venturi duct 30, where their mixing takes place.

The combustible mixture of gas and primary air exiting the second venturi duct 30 invades the second chamber 48 and through the circumferential slot 102 generates the simmering flame 104.

The gas instead of coming from the other outlet of the dual tap feeds the two first injectors 26, 28, and draws the primary air sucked from under the hob into the respective first venturi ducts 32, 34.

The combustible mixture of gas and primary air coming out of the first two venturi ducts 32, 34 invades the respective first downstream chambers 36, 40 and through the two first openings 38, 42—provided in the injector holder module 14 and the two corresponding openings 62 obtained in the external annular flame-spreader 54—enters two corresponding portions of the cavity 60 for the generation of a first (external) crown of main flames 10 and possibly of a further crown of flames (not shown in the drawings).

At the same time, the fuel mixture present in at least one of said first chambers 36 and/or 40, for example present in the first chamber 40, reaches the central flame-spreader 80 passing through the internal horizontal duct 64 and the two vertical ducts 46, 68, aligned with each other, to generate the second (internal) crown of main flames 4.

Thanks to the burner 1 according to the invention, therefore, a multi-burner for built-in hob of limited height is obtained, thanks to the substantially horizontal arrangement of the injectors and venturi, but of high power thanks to the high length of the venturi themselves which feed both the internal 4 and external 10 crowns of main flames.

Furthermore, thanks to the simmering flame 104, which is located in the circular internal portion 2 of the flame-spreader module 53 of the multi-crown burner 1 and therefore has a small diameter, a significant reduction in the minimum flow rate of this flame is obtained simmering and therefore a high burner turndown.

Since then the simmering flame 104 is placed below the internal crown of main flames 4, and therefore in a position further away from the pot placed on the burner, the turndown is further increased.

In a different embodiment (not shown in the drawings), the burner 1 according to the invention provides that also the wells which house said at least one first injector—and in particular the side wells 74, 76, which house the side injectors 26, 28—they are closed at the bottom and are equipped, like the well 72 which houses the second injector 24, with upper openings obtained in the cover 22, for sucking all the primary air necessary for operation from above the cooking hob of the burner.

In an even different embodiment (also not shown in the drawings) it is provided that the well 72 which houses the first injector 24 is closed both at the top and at the bottom, in order, on the one hand, to prevent the very small flow of gas, which feeds the simmering flame, can be disturbed by the momentary sudden depression caused by the opening of a hatch in a compartment under the hob, and on the other hand to avoid the accidental obstruction of the calibrated hole of the first injector 24 due to the environment loaded with fatty vapors and the possible overflow of liquids from the pot placed on the hob and their entry into the well 72 which houses the first injector 24.

This embodiment, which can be defined as "sealed" and which in practice provides for the realization of the cover 22 without the opening 78, generates a simmering flame in the absence of primary air. However, given the very limited quantity of gas that feeds the simmering flame, it was possible to experimentally verify satisfactory operation of the burner even in this condition.

In the embodiment illustrated in FIGS. 6 and 7, the central flame-spreader 80 of the multi-crown burner 1 is made in a single body with the external annular flame-spreader 54'. For this purpose, a closure and separation septum 106 is applied at the top to the internal annular portion 100 of the outer flame-spreader 54', which thus defines the central flame-spreader 80, for example shaped like a disk, to thus define in correspondence with the slots 94' formed in the upper edge of the external wall of the central flame-spreader 80 doors which generate the second (internal) crown of main flames 4, while the passage for the generation of the simmering flame 104 is defined above said septum 106 by a slot, preferably circumferential and substantially continuous, connected to the upper chamber 102' delimited between the septum 106 and the cover 96'.

In this embodiment, the internal duct 64', formed inside the injector holder module 14, and in particular in the cup 18', connects the first chamber 40, in which said at least one first venturi duct 32, 34 opens, with the second chamber 48' which communicates with a cavity formed in said circular internal portion 2 of the flame-spreader module 53 for the generation of a second internal ring of main flames 4; said second venturi duct 30 leads into an axial duct 46' of the central portion 44' of the cup 18' which then extends into the overlying vertical duct 68, which then leads into the upper chamber 102' which is delimited between the septum 106 and the cover 96' and which is connected with a passage slot for the generation/escape of the simmering flame 104.

In addition to the embodiments already described, in which the simmering flame 104 is continuous, as it is generated through a continuous annular slot, it is provided that it could also have the classic crown shape of distinct micro-flames, generated through a series of slots, preferably micro-cavities, obtained in the lower edge of the central flame-spreader 80 or in the upper edge of the internal annular portion 100 of the annular flame-spreader 54.

Conveniently, in the burner 1 according to the present invention, the second main flame crown 4 of the circular internal portion 2 can be and positioned above the simmering flame 104 of the circular internal portion 2 (cf. FIG. 1-5), or below the latter (see FIGS. 6 and 7).

Suitably, it is understood that the present invention also relates to an installation which includes a cooking hob in which a burner 1 is installed/applied as described above (in one of the embodiments and/or embodiments described and/or represented), both in the its essential characteristics rather than the preferential ones.

From what has been said it is clear that the gas burner according to the invention is much more advantageous than traditional multi-crown burners at least for the following reasons:

- it has a limited vertical dimension and is particularly suitable for mounting on built-in hobs,
- is capable of delivering high powers,
- distributes the flame over a large surface,
- has a very large turndown,
- is made with a limited number of pieces, is practically insensitive to disturbances related to sudden changes in pressure in the compartment below the hob, allows quick and easy access to the injectors.

The invention claimed is:

1. A multi-crown gas burner comprising an injector holder module, attachable to a cooking hob, and a flame-spreader module positioned above said injector holder module, said flame-spreader module comprising a circular internal portion which is separated from an external annular portion by a substantially annular cavity, said injector holder module comprises:

at least one first venturi duct substantially horizontal to which at least one first injector faces, said at least one first venturi duct being in fluid communication with a corresponding first chamber which is in fluidic communication with a first set of doors provided in said external annular portion, so as to generate at least one first crown of main flames, a second substantially horizontal venturi duct to which a second injector faces, said second venturi duct being in fluid communication with a zone communicating fluidly with at least one passage provided in said circular internal portion for the generation of at least one simmering flame, said at least one first chamber, which is fed by said at least one first venturi duct, communicates fluidly with a second set of doors provided in said circular internal portion of the flame-spreader module, so as to generate a second crown of main flames.

2. The gas burner according to claim 1, wherein said at least one first chamber fed by said at least one first venturi duct communicates fluidly, through a duct which is obtained inside said injector holder module, with said second set of doors provided in said circular internal portion of the flame-spreader module, so as to generate said second crown of main flames.

3. The gas burner according to claim 1, wherein said at least one first injector is configured to be powered by a first output of a dual tap, while said second injector is configured to be powered by a second outlet of said dual tap.

4. The gas burner according to claim 1, wherein said second injector is applied to the side wall of a corresponding well which is formed in said injector holder module, the corresponding well is closed at the bottom and is configured to communicate above, through at least one opening obtained in said injector holder module, with the external environment above the cooking hob, thus allowing entry of primary air from above said cooking hob.

5. The gas burner according claim 1, wherein said second injector is housed within a corresponding well, which is formed in said injector holder module and which is closed at the bottom and at the top thereof.

6. The gas burner according to claim 1, wherein said at least one first injector is applied to the side wall of a well, which is formed in said injector holder module, which is closed at the top and which is provided with an opening to communicate below with the external environment below the hob, so as to allow entry of primary air coming from underneath said hob.

7. The gas burner according to claim 1, wherein in a central portion of said injector holder module and in an overlying central portion of the flame-spreader module, two steps are provided fluidic, substantially vertical and fluidically separated or distinct from each other, which receive two separate flows of primary gas-air mixture, formed respectively in said at least one first venturi duct and in said second venturi duct.

8. The gas burner according to claim 1, wherein a central portion of said injector holder module and an overlying central portion of said flame-spreader module present an axial vertical duct surrounded by an annular chamber, which are configured to receive two separate flows of primary gas-air mixture, formed respectively in said at least one first venturi duct and in said second venturi duct.

9. The gas burner according to claim 1, wherein said first chamber, into which opens said at least one first venturi duct, fluidly communicates with at least one annular distribution chamber formed in the external annular portion of said flame-spreader module and with a circular distribution chamber obtained in the circular internal portion of said flame-spreader module.

10. The gas burner according to claim 1, wherein said flame-spreader module is made in two parts, one of which rests on said injector holder module and comprises a first cavity which communicates fluidly with said at least one first venturi duct to receive the fuel mixture for feeding said at least one first crown of main flames, wherein the other/second part, having a smaller diameter, rests on the first part and presents a second cavity, communicating fluidly with said first chamber for generation of said second crown of main flames.

11. The gas burner according to claim 10, wherein said flame-spreader module is configured so that, as the second part rests on the first part, it defines a slot which is open towards the outside and communicating fluidly with said second venturi duct, thereby defining said passage for said at least one simmering flame.

12. The gas burner according to claim 1, wherein the central portion of said flame-spreader module comprises a vertical duct fluidly communicating with a supply cavity of said second main flames crown and also comprises an underlying slot with a substantially annular development, fluidly communicating with said second venturi duct to thus define said passage for the escape of at least one simmering flame.

13. The gas burner according to claim 1, wherein the central portion of said flame-spreader module comprises a second chamber, fluidly communicating with said at least one first venturi duct for feeding said second crown of main flames, said second chamber being closed at the top by a septum for closing and separating said second chamber from an upper chamber communicating fluidly with said second venturi duct, so to feed said simmering flame.

14. A multi-crown gas burner comprising an injector holder module, connectable to a cooking hob, and a flame-spreader module positioned above said injector holder module, said flame-spreader module comprising a circular internal portion which is separated from an external annular portion by a substantially annular cavity, the injector holder module and the flame-spreader module are configured so as to define inside an overall dimension thereof in plan:

a first fluidic circuit, associated with at least one first injector, which is mounted on said injector holder module, to feed with gas and primary air a first main flame crown provided at the external annular portion of the flame-spreader module, a second fluidic circuit, associated with a second injector which is mounted on said injector holder module, to feed at least one simmering flame provided with gas and primary air provided at the circular internal portion of the flame-spreader module, a third fluidic circuit, which is in communication with said first fluidic circuit, for feeding with gas and primary air a second crown of main flames provided at the circular internal portion of the flame-spreader module.

15. An installation of a burner on a hob, comprising a hob, in which a through opening is obtained, and a burner according to claim 1, which is installed in said cooking hob at said opening.

* * * * *